US005890708A

United States Patent [19]

Song

[11] Patent Number: 5,890,708

[45] Date of Patent: Apr. 6, 1999

[54] PRINTING SYSTEM AND METHOD AUTOMATICALLY DETECTING PAPER LENGTH AND CONTROL METHOD THEREOF

[75] Inventor: Jun-Pil Song, Suwon, Rep. of Korea

[73] Assignee: Samsung Electronics Co., Ltd., Kyungki-do, Rep. of Korea

[21] Appl. No.: 781,195

[22] Filed: Jan. 10, 1997

[30] Foreign Application Priority Data

Jan. 12, 1996 [KR] Rep. of Korea ..... 519/1996

[51] Int. Cl.[6] ..... B65H 5/00; B65H 7/02

[52] U.S. Cl. ..... 271/10.03; 271/259; 271/258.04; 271/265.02

[58] Field of Search ..... 271/10.03, 10.02, 271/265.01, 258.01, 258.03, 258.04, 259, 265.02, 171

[56] References Cited

U.S. PATENT DOCUMENTS

| | | | |
|---|---|---|---|
| 4,939,676 | 7/1990 | Worsley et al. | 271/258.01 X |
| 5,464,204 | 11/1995 | Suzuki | 271/258.04 X |
| 5,580,046 | 12/1996 | Beaufort et al. | 271/265.02 X |

FOREIGN PATENT DOCUMENTS

| | | | |
|---|---|---|---|
| 127341 | 5/1990 | Japan | 271/265.01 |
| 198944 | 8/1990 | Japan | 271/265.01 |

*Primary Examiner*—Boris Milef

*Attorney, Agent, or Firm*—Sughrue, Mion, Zinn, Macpeak & Seas, PLLC

[57] ABSTRACT

A printing system which can automatically detect the length of paper fed into the system and control the system based upon the detected length of the paper. The printing system has a paper driver for conveying papers loaded at the initial stage of printing by a preset step unit in response to a conveyance control signal, and a paper feeder for outputting loaded paper size selection information and feeding the loaded papers to the initial stage of the paper driver in response to a paper feed control signal, a paper sensor located on a forefront of the paper driver which detects the leading and trailing ends of the paper, and a controller for outputting the paper feed control signal in response to a printing command, allowing the printing operation, outputting the conveyance control signal, transferring the paper, counting the number of transfer steps in an interval where a paper detection signal is enabled, calculating the counted number as paper length, comparing the value of paper length with a value of a paper length corresponding to the paper size selection information, and completing the printing operation.

12 Claims, 6 Drawing Sheets

PRIOR ART

PRINTING SYSTEM AND METHOD AUTOMATICALLY DETECTING PAPER LENGTH AND CONTROL METHOD THEREOF

BACKGROUND OF THE INVENTION

The present invention generally relates to a printing system and a method of controlling the printing system. More particularly, the present invention relates to a printing system and method which controls paper conveyance using a step motor and automatically detects the size of paper fed into the system before performing the printing operation.

In a conventional printing system, such as a drum printer or capstan printer, print media is conveyed (e.g., via a step motor) to a print head so that input images can be printed on the paper.

FIG. 1 is a block diagram of a conventional printing system for controlling the paper conveyance in which the capstan-driving technique is employed. The printing system includes: paper cassette 12 on which sheets of paper are stacked; paper feeding motor 14 which conveys the paper loaded on paper cassette 12; paper driving portion which consists of platen 22, capstan roller 18, and step motor 24; and a paper output portion with paper output motor 26; and central processing unit (CPU) 16 that controls paper feeding motor 14, step motor 24, and paper output motor 26 by analyzing the paper selection information from paper cassette 12. In FIG. 1, reference numeral 20 denotes a pinch roller which rotates with the turning of the capstan roller 18.

The conventional printing system shown in FIG. 1 receives information as to the size of the paper loaded in paper cassette 12. This paper size information is entered by a user through the paper selector switch on paper cassette 12. A sensor installed in the printing system senses the paper size information and transmits it to CPU 16.

CPU 16 stores the paper size information transmitted from the sensor in its internal memory and controls paper feeding by computing the paper conveyance distance from the paper size information in response to a command to start printing. Typical paper sizes include Letter-, A4- and OA4 (oversize A4)-sized sheets of paper, and the CPU 16 stores in a memory, information about the paper conveyance distances X, Y and Z according to the paper sizes/types.

When the paper size information is transmitted from the sensor under the present condition, the CPU 16 computes a paper feeding distance during printing according to the paper size, and controls paper feed motor 14 to feed the paper into the system. When the paper selector switch on the paper cassette is adjusted for Letter, A4 or OA4 paper sizes, CPU 16 selects the corresponding paper conveyance distance of "X", "Y" or "Z", and controls the amount of paper to be fed into the system by the selected paper conveyance distance. Accordingly, when the paper feeding is completed, CPU 16 assigns a proper print position to the paper according to the paper size information, and allows the printing operation. The amount of paper fed into the system can be regulated by controlling paper feeding motor 14.

Conventional printing systems, which regulate the amount of paper fed into the system according to paper size information from the paper size selector switch have many problems, as set forth in the examples below. The printing system to which the present invention can be most effectively applied will be described, while reviewing these problems. That is, the following description concerns a sublimation color printer which employs the sublimation printing technique and capstan driving technique and uses typical paper sizes of A4—297×210 mm; Letter—279×216 mm; and OA4—337×243 mm. FIGS. 2A, 2B, 2C, 3A, 3B and 3C are views for describing the paper feeding problems of conventional techniques.

FIGS. 2A, 2B and 2C show the sizes of paper and the differences in paper conveyance distance. FIG. 2A depicts the length of each paper, and FIG. 2B shows the OA4-sized paper location at the initial stage of printing. FIG. 2C depicts each location of the OA4-sized paper and other print media after the paper feeding.

FIGS. 3A, 3B and 3C show image outputs on OA4-, A4- and Letter-sized sheets of paper. FIG. 3A describes printing areas of OA4-, A4- and Letter-sized sheets of paper during the normal printing operation, and FIG. 3B is a view for describing a printing area of paper whose size is smaller than the paper selection information in a sublimation color printer. FIG. 3C illustrates printing areas of paper whose size is larger than the paper selection information.

Some of the paper feeding problems of conventional techniques are now described with reference to FIGS. 2A, 2B, 2C, 3A, 3B and 3C. If the size of paper loaded on the paper cassette 12 does not correspond to the paper size information preset in the paper cassette 12, i.e. if the actual size of paper loaded thereon is either smaller or larger than the paper size information of the paper cassette 12, the following problems may occur.

If the paper loaded in paper cassette 12 is Letter- or A4-sized while the paper selector switch of the paper cassette 12 is adjusted for OA4 paper size, or if the paper loaded on the paper cassette 12 is Letter-sized while the paper selector switch of paper cassette 12 is adjusted for A4 paper size, the capstan roller 18 and the pinch roller 20 are still rotated by the step motor 24 even after the paper is delivered to them. This causes the tail of the paper to slip out of the two rollers, and the printing system cannot operate normally.

For example, when the paper loaded on paper cassette 12 is Letter-sized while the paper selector switch of the paper cassette 12 is adjusted for OA4 paper size, the paper fails to be inserted between the capstan roller 18 and the pinch roller 20 during paper feeding so CPU 16 cannot control the printing operation. This problem may also occur when A4-sized paper is loaded in paper cassette 12. Provided the paper conveyance distances X, Y, Z with respect to letter-, A4- and OA4-sized sheets of paper are 269 mm, 287 mm and 327 mm which are smaller than their actual paper lengths of 279 mm, 297 mm and 337 mm by 10 mm, the differences between "Z" and "X", "Z" and "Y", and "Y" and "Z" are 58 mm, 40 mm, 18 mm. Thus, in the above cases, the paper fails to reach capstan roller 18 and pinch roller 20.

The above description is depicted in FIGS. 2A, 2B and 2C. FIG. 2A shows the actual lengths of Letter-, A4- and OA4-sized sheets of paper, and FIG. 2B depicts the initial stage of paper feeding in which the OA4-sized paper is inserted between capstan roller 18 and pinch roller 20. The dimension "Z", of FIG. 2B, denotes a distance by which the paper is moved by capstan roller 18. FIG. 2C illustrates the location of the paper that has been moved by distance "Z". As shown in FIG. 2C, the tail of the OA4-sized paper is interposed between the capstan roller 18 and the pinch roller 20 by about 10 mm, and the A4- and Letter-sized sheets of paper fail to remain inserted between the capstan roller 18 and the pinch roller 20 so the printing operation cannot perform normally.

Under these circumstances, even if printing is carried out by preventing the paper from slipping out of the capstan roller 18 and the pinch roller 20 using some type of control device, each paper may have different printing dimensions, and input images cannot be printed without proper alignment.

FIGS. 3A, 3B and 3C show image outputs on OA4-, A4- and Letter-sized sheets of paper during the printing operation under the above condition. FIG. 3A describes printing areas of OA4-, A4- and Letter-sized sheets of paper during the normal printing operation wherein the paper loaded in paper cassette 12 corresponds to the paper size information of paper cassette 12.

In FIG. 3A, L1 and L2 are the differences in image length between OA4 and A4 sheets and between OA4 and Letter sheets. FIG. 3B shows cases where the paper loaded in paper cassette 12 does not correspond to the paper size information of paper cassette 12. In the cases of FIG. 3B, the paper loaded on the paper cassette 12 is either Letter- or A4-sized where the paper selector switch of paper cassette 12 is adjusted for OA4 paper size, or the paper loaded in the paper cassette 12 is Letter-sized while the paper selector switch of paper cassette 12 is adjusted for A4 paper size. In these cases, since the paper size is smaller than the size of an image to be printed, the print length is only C or D which are shorter than the overall image size S. The printing continues for the distances "L1" or "L2", so that the tail of the paper fails to be inserted between the capstan roller 18 and the pinch roller 20. At this point, because the paper selector switch is adjusted for OA4 paper size, the thermal printing head (TPH) keeps on producing heat. Accordingly, the heat produced by the TPH is directly applied to platen 22, damaging platen 22 which causes printing errors. When using a sublimation color printer, this entails a loss on its color ink ribbon by an amount for one-sheet printing. Moreover, the heat from the TPH may reduce the lives of platen 22 and the TPH.

If the paper loaded in paper cassette 12 is larger than the paper selection information of paper cassette 12, i.e. if the paper selector switch is adjusted for Letter paper size and the paper in paper cassette 12 is OA4-sized one, this results in a waste of paper. FIG. 3C illustrates printing areas of OA4-, A4- and Letter-sized sheets of paper when the printing operation is carried out under the above-mentioned condition. As shown in FIG. 3C, even though input images can be printed on the paper, the paper size is too large for the output images, which causes the waste of paper and prevents the input images from being printed on the middle of the paper. Since print media used for the sublimation color printer is very expensive, and it is not easy for users to pay for its upkeep and repair. The heat produced by the TPH affects the durability of the TPH and capstan roller reducing the reliability of the printing system.

SUMMARY OF THE INVENTION

It is an objective of the present invention to provide a printing system which overcomes these and other problems by automatically detecting the length of paper fed into the system for printing.

It is another objective of the present invention to provide a printing system which can perform the printing operation by automatically detecting the length of paper fed into the system.

It is still another objective of the present invention to provide a printing system which can automatically detect the size of paper fed into the system for the purpose of protecting the printing mechanism.

According to the present invention, a paper sensor operates until the paper conveyance is completed during printing, and a central processing unit compares the length of paper loaded on a paper cassette with the paper size information of the paper cassette, and if they do not match, it stops the printing operation and automatically discharges the paper from the printing system. Thus, the present invention may enhance the self-diagnosis function of a printing system and reduce waste of print media and damage to the system's components.

These objectives of the present invention are proposed to overcome the above-described disadvantages, drawbacks, and shortcomings of presently available systems.

In order to realize the above objectives, the present invention provides a printing system having a paper driving mechanism for conveying paper loaded at the initial stage of printing, by a step preset in response to a signal for controlling paper conveyance, and a paper feeding portion providing paper size selection information and moving the paper to the initial position of the paper driving portion in response to a signal for controlling the paper feed. The printing system includes: a paper sensor located on a forefront of the paper driving portion's initial position, which is energized when the paper is conveyed and de-energized when detecting the paper's tail; a control portion generating signals for controlling the paper feed in response to print commands, allowing the print operation, generating the signal for controlling paper conveyance, counting the number of paper conveyance steps for a period of which an output of the sensing means attains a "high" level, calculating the paper length from the number of steps, and comparing the measured length with that of the paper size selection information, and if they do not match, stopping the printing operation.

Another aspect of the present invention provides a printing system having: a paper driving mechanism for conveying paper loaded on an initial stage of printing by the number of paper conveyance steps in response to a step control signal; a paper feeding portion producing paper size selection information and moving the paper to the initial position of the paper driving portion in response to a paper feeding control signal; a paper sensor located at a predetermined position spaced from the center of the driving portion by a predetermined distance and being energized when the paper is conveyed and de-energized when no paper is conveyed; a method of automatically measuring the length of the paper, including the steps of, storing a paper length information corresponding to the paper size selection information, the number of paper conveyance steps with respect to the paper length, the distance between the driving portion and paper sensor, and the number of steps for a unit of paper conveyance; performing the print operation by producing the step control and paper feeding control signals in response to a command to print, and counting the number of paper conveyance steps until an output signal of the sensor goes "low"; converting the number into a value of paper length in response to the disabling of the output signal of the sensor; and comparing the value of paper length with that of the paper size selection information, and if the former is smaller than the latter, stopping the printing operation.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein:

FIGS. 2A, 2B and 2C show the sizes of paper and the difference of the paper conveyance distances, wherein FIG. 2A depicts the length of each paper, FIG. 2B shows the OA4-sized paper location upon initial printing, and FIG. 2C depicts each location of the OA4-sized paper and other printing media after the paper feeding;

FIGS. 3A, 3B and 3C show image outputs produced on OA4-, A4- and Letter-sized sheets of paper, wherein FIG. 3A is a view for describing printing areas of OA4-, A4- and Letter-sized sheets of paper during the normal printing operation, FIG. 3B is a view for describing a printing area of paper whose size is smaller than the paper selection information in a sublimation color printer, and FIG. 3C illustrates printing areas of paper whose size is larger than the paper selection information;

DETAILED DESCRIPTION OF THE PREFERRED EMBODIMENT

Figure 1:
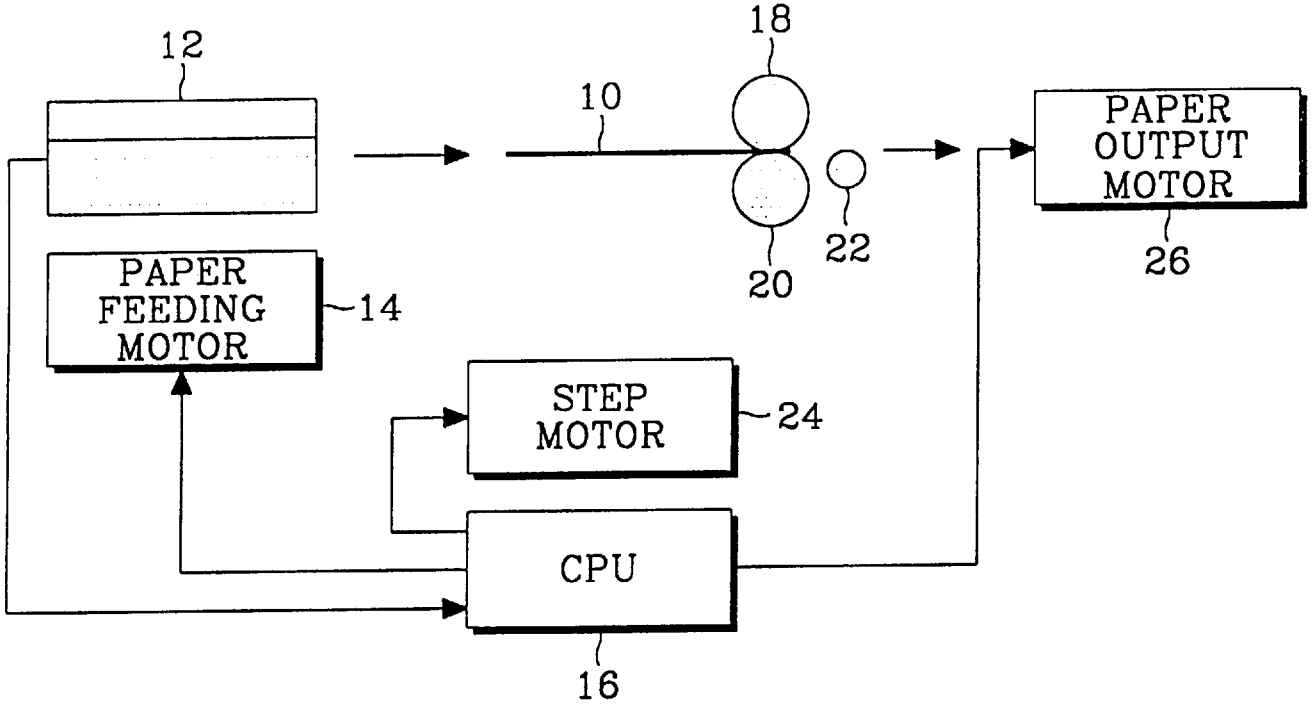
FIG. 1 is a block diagram showing the construction of a conventional printing system for controlling the paper conveyance.
Figure 2A:
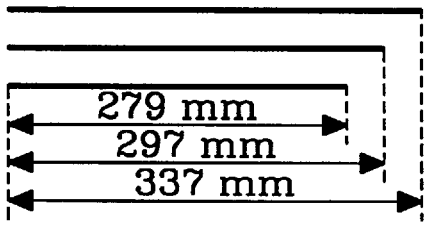
Figure 2B:
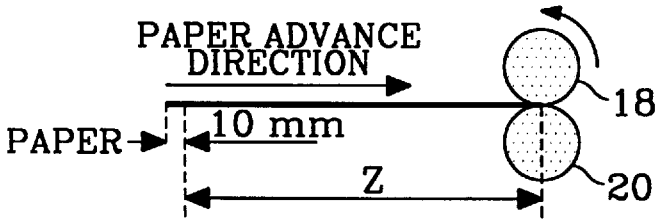
Figure 2C:
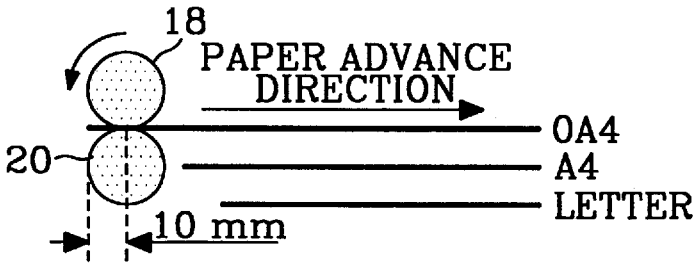
Figure 3A:
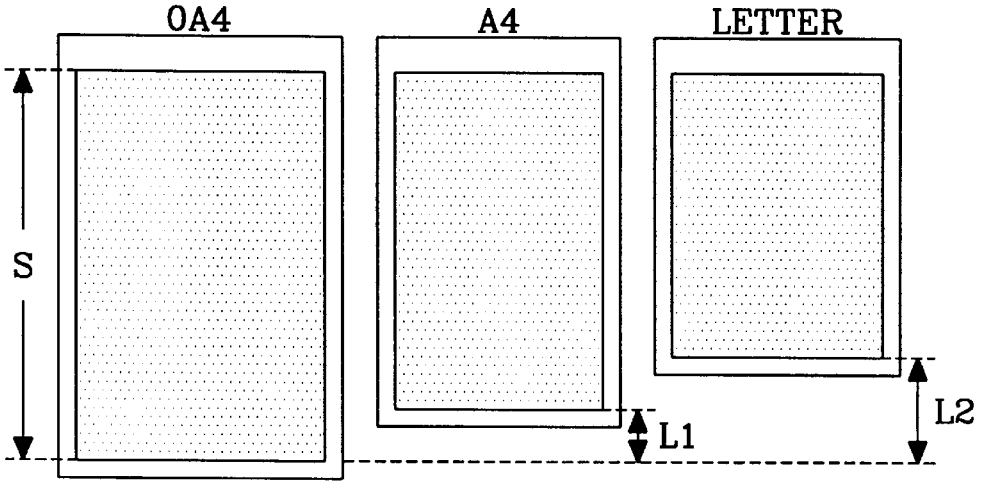
Figure 3B:
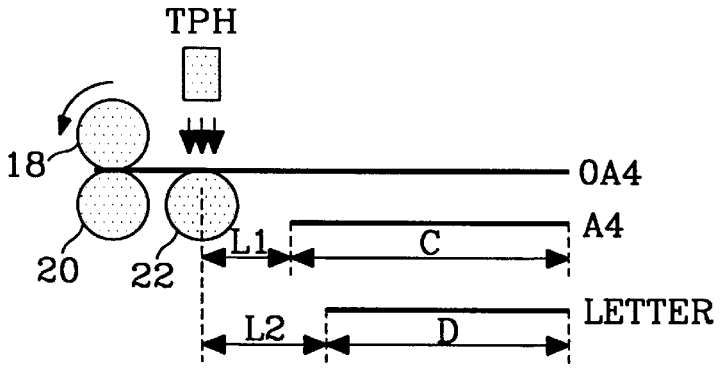
Figure 3C:
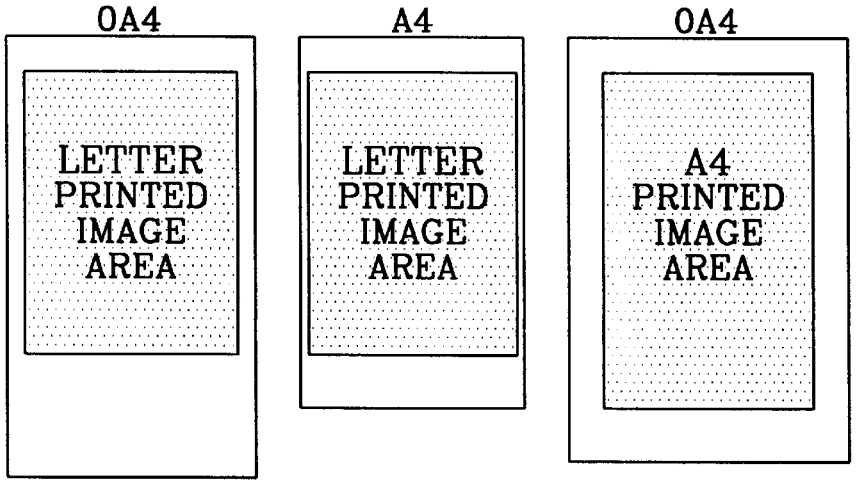

Reference will now be made in detail to the preferred embodiment of the present invention, examples of which are illustrated in the accompanying drawings. Like reference numerals designate like reference parts throughout the specification and drawings.

Figure 4:
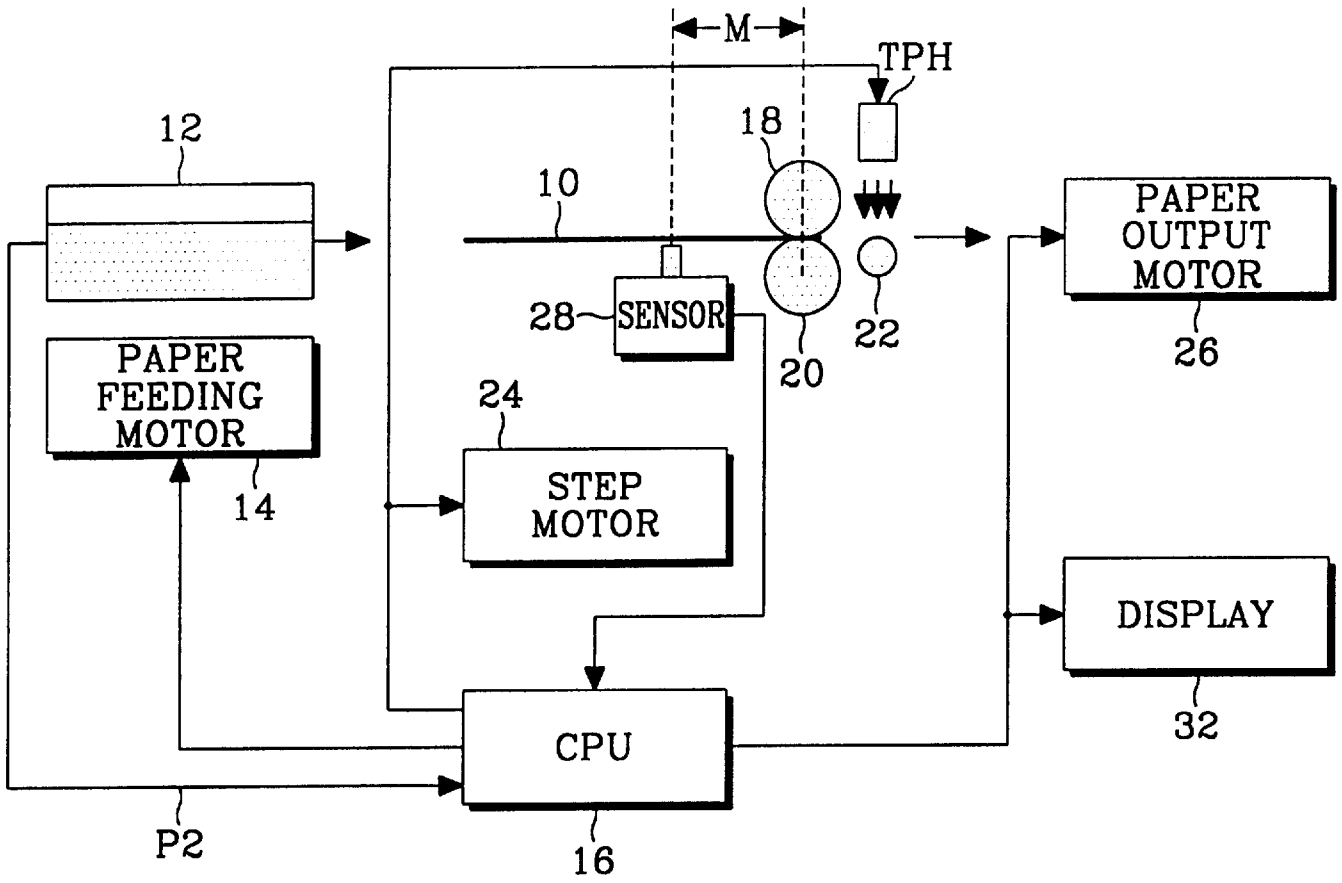
FIG. 4 is a block diagram showing the construction of a printing system for controlling the paper conveyance in accordance with the present invention.

FIG. 4 is a block diagram of a printing system for controlling paper conveyance in accordance with the present invention. The printing system of FIG. 4 is a sublimation color printer in which a capstan roller serves as the paper conveyor, and includes a paper feeding portion, a paper driving portion, a paper sensor, a paper output portion, a display, a control portion, etc. The paper feeding portion consists of paper cassette 12 and paper feeding motor 14. The paper sensor is located at a predetermined position of the paper path to detect the presence of paper. The paper driving portion includes capstan roller 18, pinch roller 20 and step motor 24. The paper output portion consists of paper output motor 26. The control portion is realized through a central processing unit or microprocessor. The CPU 16 of FIG. 4 serves as the control portion, and controls the overall operation of the printing system from the paper feeding to the paper output.

Figure 5A:
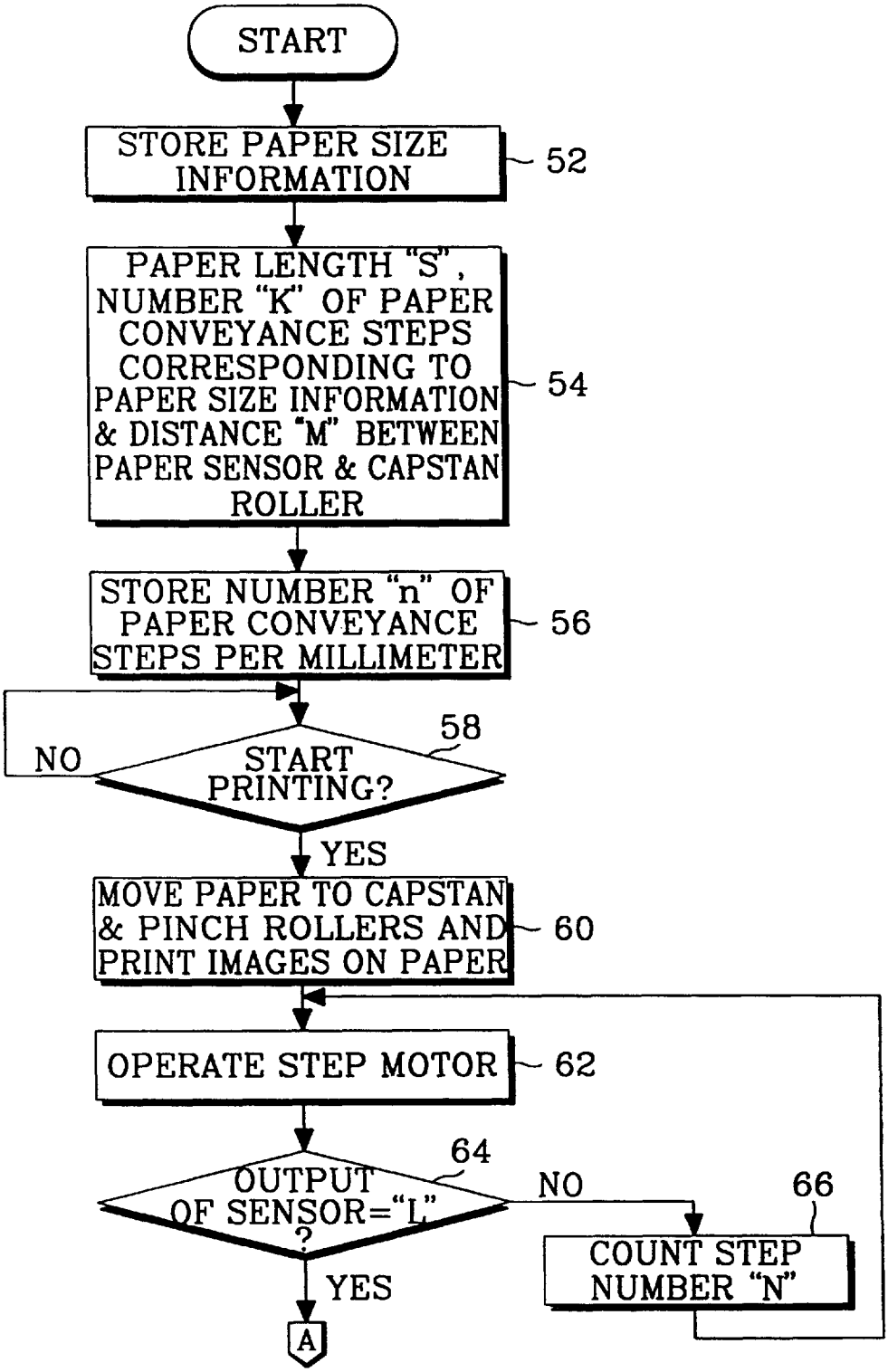
FIGS. 5A and 5B are a control flow chart showing steps of automatically detecting the paper size in accordance with the present invention.
Figure 5B:
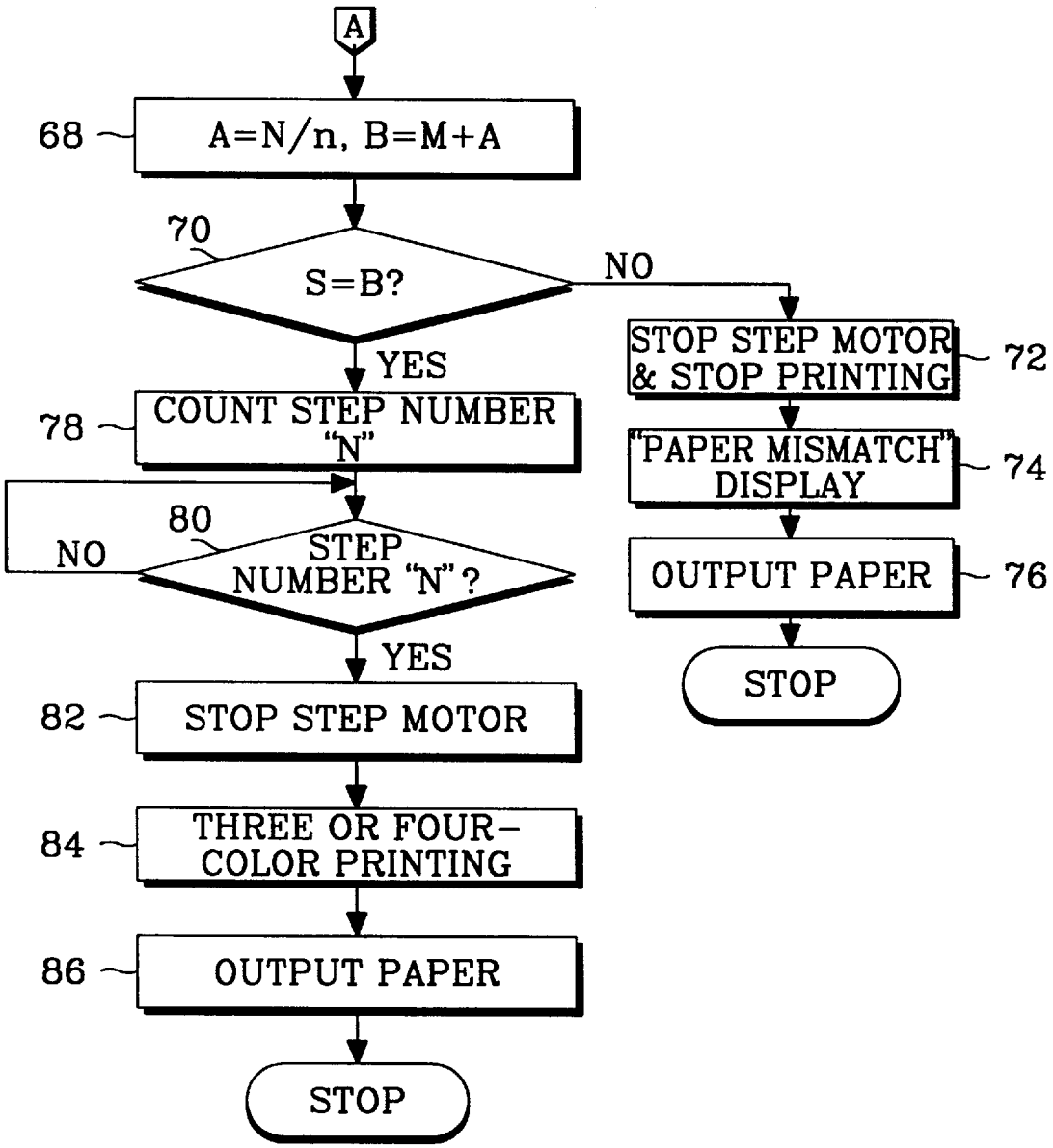

FIGS. 5A and 5B are a control flow chart showing steps of automatically detecting the paper size in accordance with the present invention. This program can be stored in the read only memory (ROM) portion of the CPU 16, for example.

The printing operation according to the automatic paper size detection is now described referring to FIGS. 4 and 5.

Once power is applied to the printing system, the CPU 16 allows (S52) the paper information, P2, from the paper selector switch of paper cassette 12, to be stored in the CPU 16's random access memory (RAM). The CPU 16 stores (S54) paper length "S" corresponding to the paper size information from paper cassette 12, the number, "K", of paper conveyance steps precalculated in proportion to the paper length "S", and a distance "M" from a paper sensor 28 to the middle of the capstan roller 18. "M" is preprogrammed in the printing system.

The CPU 16 stores (S56) the number "n" of paper conveyance steps per millimeter of paper length in RAM, and is in standby mode until the command to print is input to the printing system. At this point, the paper loaded in the paper cassette 12 has not been yet moved to the paper path, and the output of the paper sensor 28 is "L". After the above-described initialization steps, the CPU 16 detects (S58) if a command to print is input to the printing system.

When a command to print is input to the printing system while the CPU 16 is in standby mode, the CPU 16 allows (S60) paper feed motor 14 to operate so that the top edge of paper 10 in the paper cassette 12 is moved to a point where the capstan roller 18 and the pinch roller 20 meet thereby completing the paper loading. The CPU 16 provides paper feed motor 14 with a signal for controlling the paper feeding to move the paper 10 to the initial stage of printing, and operates a thermal printing head TPH to carry out three- or four-color printing operations. The paper sensor 28 disposed on a predetermined spot of the paper path detects the paper 10's loading condition, and outputs a logic "high" signal. The output signal of the sensor 28 remains at a high level until the tail of the paper 10 passes the sensor 28.

After completion of the paper loading, the CPU 16 allows (S62) the step motor 24 to operate for paper conveyance. The CPU 16 supplies a driving control signal to the step motor 24, and rotates the capstan roller 18 and the pinch roller 20 to convey the paper. Through Steps 64 and 66, the CPU 16 counts the number "N" of the step motor driving steps for a period of which an output of the sensor 28 goes "high".

When the conveyance of the paper 10 continues so its tail passes the paper sensor 28, the sensor 28's output attains a "low" level, and the CPU 16 computes (S68) the paper length "B" by using the number "N" of the steps and the stored number "n" of paper conveyance steps per millimeter of paper length. The number of steps for a period of which the "high" output signal of sensor 28 goes "low" equals "N", and the length "A" of the paper 10 conveyed during this period can be stated as the following equation 1:

$$A=N/n \qquad \text{(Equation 1)}$$

wherein "n" is the number of paper conveyance steps per millimeter of paper length.

The distance from paper sensor 28 to the middle of the capstan roller 18 equals "M", and the overall length "B" of the paper can be obtained by the equation of:

$$B=A+M \qquad \text{(Equation 2)}$$

The CPU 16 which has calculated the overall length of the paper being conveyed via the paper path, compares (S54) its output value with that of the paper size information S stored in memory at Step 54, and determines (S70) if the length "B" of paper loaded in the paper cassette 12 corresponds to the paper size information "S" set in paper cassette 12.

If the CPU 16 determines that they correspond, it operates the step motor 24 and allows the continuous printing operation. The CPU 16 counts (S78) the number "N" of the step motor driving steps. The CPU 16 compares (S80) the number "N" with the number "K" of the paper conveyance steps preset in proportion to paper length "S", and lets the printing operation go on until "N" equals "K". When "N" is increased through the above-described process and equals "K", the CPU 16 stops (S82) step motor 24, and allows (S84 and S86) the subsequent printing. The CPU 16 then operates paper output motor 26 to eject the paper to the outside of the printing system.

If the CPU 16 determines that the length "B" of the paper loaded in paper cassette 12 does not correspond to the paper size information "S", it stops (S72) step motor 24, and displays a "Paper Mismatch" message on display 32. The CPU 16 operates (S76) the paper output motor 26 to discharge the paper from the printing system. Accordingly, when the size of the paper loaded on the paper cassette 12 does not correspond to the paper size information preset in the paper cassette by a user, the paper is automatically discharged to the outside as soon as input images are printed on the tail of the paper so that the platen and other components are not damaged, and paper is not wasted, due to the paper mismatch.

It should be understood that the present invention is not limited to any particular embodiment disclosed herein. For example, the actual length of the paper could be measured by various approaches which need not employ the sensor of the preferred embodiment. In addition, the loaded paper preset size could be set in various ways, e.g., by a lever on the cartridge, by an electronic input panel, by the type of cartridge inserted into the printer, etc . . . . Furthermore, as used herein the word "paper" includes traditional "paper" as well as printable sheets made from other than wood-pulp materials, e.g., transparencies, film sheets, and other sheets on which printers can print. There are many other variations to the examples discussed above, which would still be within the scope and spirit of the invention which is defined by the following claims.

What is claimed is:

1. A printing system comprising:

a paper driver for conveying paper loaded at an initial stage of printing by a preset step unit in response to a conveyance control signal;

a paper feeder for outputting loaded paper size selection information, and feeding said loaded paper to said initial stage of said paper driver in response to a paper feed control signal;

a paper sensor located on a forefront of said paper driver, for detecting a leading end and a trailing end of said paper as said paper is conveyed; and a controller for controlling a printing operation by generating said paper feed control signal in response to a printing command, generating said conveyance control signal, counting a number of transfer steps in an interval where a paper detection signal is enabled, calculating a value of paper length based on the counted number of transfer steps, determining an actual length of said paper by adding said value of paper length to a predetermined distance between said driver and said paper sensor, and comparing said actual paper length with the length of said paper size selection information.

2. The printing system according to claim 1, wherein said controller includes a memory for storing paper length information according to the paper size information from said paper feeder and the number of paper conveyance steps corresponding to said paper length information.

3. The printing system according to claim 2, wherein said paper sensor is located at a position spaced from a middle portion of said driver toward said paper feeder by a predetermined distance.

4. A method of automatically detecting a length of the paper in a printing system having a paper driver for conveying paper loaded on an initial stage of printing by the number of paper conveyance steps in response to a step control signal, a paper feeder for producing paper size selection information and moving the paper to the initial position of said paper driver in response to a paper feed control signal, and a paper sensor located on a position spaced from a middle portion of said driver by a predetermined distance, for detecting a leading end and a trailing end of said paper as said paper is conveyed, comprising the steps of:

storing a paper length information corresponding to said paper size selection information;

storing the number of paper conveyance steps with respect to the paper length;

storing a distance between said driver and said paper sensor;

storing the number of steps for a unit of paper conveyance;

performing the printing operation by producing said step control signal and a paper feed control signal in response to a print command;

counting the number of paper conveyance steps until said sensor detects said trailing end of said paper;

converting said number of paper conveyance steps into a value of paper length in response to the detection of the trailing end of said paper by said sensor; and comparing said value of paper length with that of said paper size selection information, and if said value of paper length is smaller than said paper size selection information, ending the printing operation.

5. The method according to claim 4, wherein said converting step comprises the steps of:

dividing the number of paper conveyance steps by the number of steps for a unit of paper conveyance in order to obtain a value of paper length; and adding the distance between said driver and said paper sensor to said value of paper length to obtain the overall paper length.

6. The method according to claim 4 or 5, further comprising the step of stopping the printing operation and displaying an error message if said value of paper length does not correspond to that of said paper size selection information.

7. A printer comprising:

a paper holder for storing paper before printing;

a paper driver for conveying sheets of paper along a paper conveyance path;

a paper length input device operable to set a preset paper length;

a paper sensor located on said paper conveyance path at a predetermined distance from said paper driver, for detecting a leading end and a trailing end of a sheet of paper as said sheet of paper is conveyed along said paper conveyance path;

a paper length measurer operable to determine the actual length of a sheet of paper based on said predetermined distance between said paper sensor and said driver and a number of paper conveyance steps of said paper driver counted during an interval between a detection of a leading end and a trailing end of said sheet of paper by said paper sensor; and a controller operable to input said measured actual paper length and said preset paper length, compare said two input paper lengths, and control the operation of said printer based upon the results of the comparison, wherein said controller stops said printer from printing on said sheet of paper before said printer has completed printing on the entire length of said sheet of paper, if said measured paper length does not correspond to said preset paper length.

8. The printer according to claim 7, wherein said control comprises at least one of displaying an error message, allowing said printer to print on said sheet of paper, and stopping said printer from printing on said sheet of paper.

9. The printer according to claim 8, wherein said controller allows said printer to print on said sheet of paper if said measured paper length corresponds to said preset paper length.

10. A method of controlling a printer which prints on individual paper sheets, said printer having a paper driver for conveying paper and a paper sensor located at a predetermined distance from said paper driver, the method comprising the steps of:

setting a preset paper length as an expected length of an individual paper sheet;

conveying said sheet of paper along a paper conveyance path of said printer;

counting a number of paper conveyance steps of said paper driver during an interval between a detection of a leading end and a trailing end of said sheet of paper by said paper sensor;

converting said number of paper conveyance steps into a value of paper length;

determining the actual length of said sheet of paper conveyed based on said value of paper length and said predetermined distance from said paper sensor to said paper driver;

comparing said actual length of said sheet of paper and said preset paper length; and controlling the operation of said printer based upon the results of the comparison, and stopping said printer from printing on said sheet of paper before said printer has completed printing on the entire length of said sheet, if said actual paper length does not correspond to said preset paper length.

11. The method according to claim 10, wherein said controlling step further comprises at least one of displaying an error message, allowing said printer to print on said sheet of paper, and stopping said printer from printing on said sheet of paper.

12. The method according to claim 11, wherein said controlling step further comprises the step of allowing said printer to print on said sheet of paper if said actual paper length corresponds to said preset paper length.

* * * * *